US007819615B2

(12) United States Patent
Trovinger et al.

(10) Patent No.: US 7,819,615 B2
(45) Date of Patent: Oct. 26, 2010

(54) METHOD AND APPARATUS FOR FINISHING SHEETS FOR A BOUND DOCUMENT

(75) Inventors: Steven William Trovinger, Palo Alto, CA (US); Miquel Boleda, Palo Alto, CA (US); Abdolreza Movaghar, Palo Alto, CA (US); Greg Burke, Palo Alto, CA (US); Eng-Long Goh, Palo Alto, CA (US)

(73) Assignee: Hewlett-Packard Development, Houston, TX (US)

( * ) Notice: Subject to any disclaimer, the term of this patent is extended or adjusted under 35 U.S.C. 154(b) by 1358 days.

(21) Appl. No.: 11/294,832

(22) Filed: Dec. 6, 2005

(65) Prior Publication Data

US 2007/0128004 A1 Jun. 7, 2007

(51) Int. Cl.

| | |
|---|---|
| ***B42C 9/00*** | (2006.01) |
| ***B42C 13/00*** | (2006.01) |
| ***B42B 9/00*** | (2006.01) |
| ***B42B 5/00*** | (2006.01) |
| ***B42B 2/00*** | (2006.01) |
| ***B42B 2/02*** | (2006.01) |
| ***B41L 43/12*** | (2006.01) |
| ***B65H 5/30*** | (2006.01) |
| ***B65H 39/00*** | (2006.01) |
| ***B65H 39/02*** | (2006.01) |
| ***B65H 41/00*** | (2006.01) |
| ***B65H 33/04*** | (2006.01) |

(52) U.S. Cl. ..... 412/1; 412/22; 412/23; 412/33; 270/37; 270/52.17; 270/52.18; 270/58.08

(58) Field of Classification Search ..... 412/1, 412/16, 18, 22, 23, 25, 33; 270/37, 52.17, 270/52.18, 58.08; 227/20, 25, 66, 68, 85, 227/88, 90; 493/355, 396
See application file for complete search history.

(56) References Cited

U.S. PATENT DOCUMENTS

| | | | | |
|---|---|---|---|---|
| 1,932,153 | A * | 10/1933 | Bergendahl | 281/15.1 |
| 5,284,466 | A * | 2/1994 | Magnusson et al. | 493/385 |
| 6,099,225 | A * | 8/2000 | Allen et al. | 412/32 |
| 6,550,756 | B2 | 4/2003 | Trovinger | |
| 6,554,267 | B2 | 4/2003 | Trovinger | |
| 6,578,838 | B2 | 6/2003 | Trovinger et al. | |
| 6,673,002 | B2 | 1/2004 | Trovinger et al. | |
| 6,682,285 | B2 | 1/2004 | Trovinger et al. | |
| 6,708,967 | B1 | 3/2004 | Trovinger et al. | |
| 6,715,749 | B2 | 4/2004 | Trovinger | |
| 6,796,554 | B2 | 9/2004 | Trovinger | |
| 6,808,479 | B2 | 10/2004 | Trovinger et al. | |
| 6,834,853 | B2 | 12/2004 | Trovinger et al. | |
| 6,837,841 | B2 | 1/2005 | Trovinger | |

(Continued)

FOREIGN PATENT DOCUMENTS

EP 0992 365 A1 4/2000

(Continued)

*Primary Examiner*—Dana Ross
*Assistant Examiner*—Kyle Grabowski

(57) ABSTRACT

A method of finishing a plurality of sheets for a bound document. The method comprises accumulating a stack of sheets at a first position, scoring the sheets at the first position, and outputting the stack of scored sheets from the first position.

11 Claims, 11 Drawing Sheets

U.S. PATENT DOCUMENTS

| | | | |
|---|---|---|---|
| 6,855,101 | B2 | 2/2005 | Trovinger et al. |
| 2002/0168247 | A1 | 11/2002 | Trovinger et al. |
| 2003/0069118 | A1 | 4/2003 | Trovinger et al. |
| 2003/0069119 | A1 | 4/2003 | Trovinger et al. |
| 2003/0069121 | A1 | 4/2003 | Trovinger et al. |
| 2003/0161704 | A1 | 8/2003 | Trovinger |
| 2003/0161705 | A1 | 8/2003 | Trovinger |
| 2003/0162644 | A1 | 8/2003 | Trovinger |
| 2004/0041326 | A1 | 3/2004 | Trovinger |
| 2004/0048728 | A1 | 3/2004 | Trovinger et al. |
| 2004/0052613 | A1 | 3/2004 | Trovinger |
| 2004/0063560 | A1 | 4/2004 | Trovinger |
| 2004/0089999 | A1 | 5/2004 | Trovinger et al. |
| 2004/0091336 | A1 | 5/2004 | Trovinger |
| 2004/0092377 | A1 | 5/2004 | Trovinger |
| 2004/0094884 | A1 | 5/2004 | Trovinger et al. |
| 2004/0094891 | A1 | 5/2004 | Trovinger et al. |
| 2004/0175255 | A1 | 9/2004 | Trovinger et al. |
| 2004/0188910 | A1 | 9/2004 | Trovinger et al. |
| 2004/0239027 | A1 | 12/2004 | Trovinger et al. |
| 2005/0056986 | A9 | 3/2005 | Trovinger et al. |

FOREIGN PATENT DOCUMENTS

| | | |
|---|---|---|
| JP | 04361096 | * 12/1992 |
| WO | WO 00/18583 | 4/2000 |

* cited by examiner

METHOD AND APPARATUS FOR FINISHING SHEETS FOR A BOUND DOCUMENT

BACKGROUND

Electronic document publishing often demands more than a stack of paper in an output tray of an office printer. Typically, a plurality of duplex printed sheets are bound into finished documents by a publishing system that prints and finishes books. Publishing systems perform operations such as collating, binding, folding, trimming, stapling, hole drilling, etc. These finishing operations are typically performed on all of the sheets in a book at one time, which generally requires the use of high forces, powerful motors, and dangerous cutting devices. Consequently, the systems adapted to perform these functions are relatively expensive and often exceed the cost of other desktop or office printers. As such, known publishing systems are not generally well suited for use in low-cost desktop bookmaking.

Other typical publishing systems incorporate sheetwise operations, which are performed on individual sheets that are later accumulated or stacked to form the document. As such, sheets are individually trimmed, scored, etc. before finally being collated into a stack for folding and stapling. Although using sheetwise operations within the publishing system generally decreases the finishing forces, the motor power, etc. required by the publishing system, processed sheets are generally stacked and folded in subsequent finishing operations, which generally requires a relatively large footprint or height of the publishing system. Since desktop or office space is typically at a premium, a need exists for a publishing system that decreases forces and motor power needed to publish a book while providing a compact system suitable for use with office printers and for methods associated therewith.

SUMMARY

Once aspect of the present invention relates to a method of finishing a plurality of sheets for a bound document. The method comprises accumulating a stack of sheets at a first position, scoring the sheets at the first position, and outputting the stack of scored sheets from the first position.

BRIEF DESCRIPTION OF THE DRAWINGS

Embodiments of the invention are better understood with reference to the following drawings. Elements of the drawings are not necessarily to scale relative to each other. Like reference numerals designate corresponding similar parts.

DETAILED DESCRIPTION

In the following detailed description, reference is made to the accompanying drawings which form a part hereof, and in which is shown by way of illustration specific embodiments in which the invention may be practiced. In this regard, directional terminology, such as "over," "upper," "lower," "on," "length," "width," etc., is used with reference to the orientation of the FIG.(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
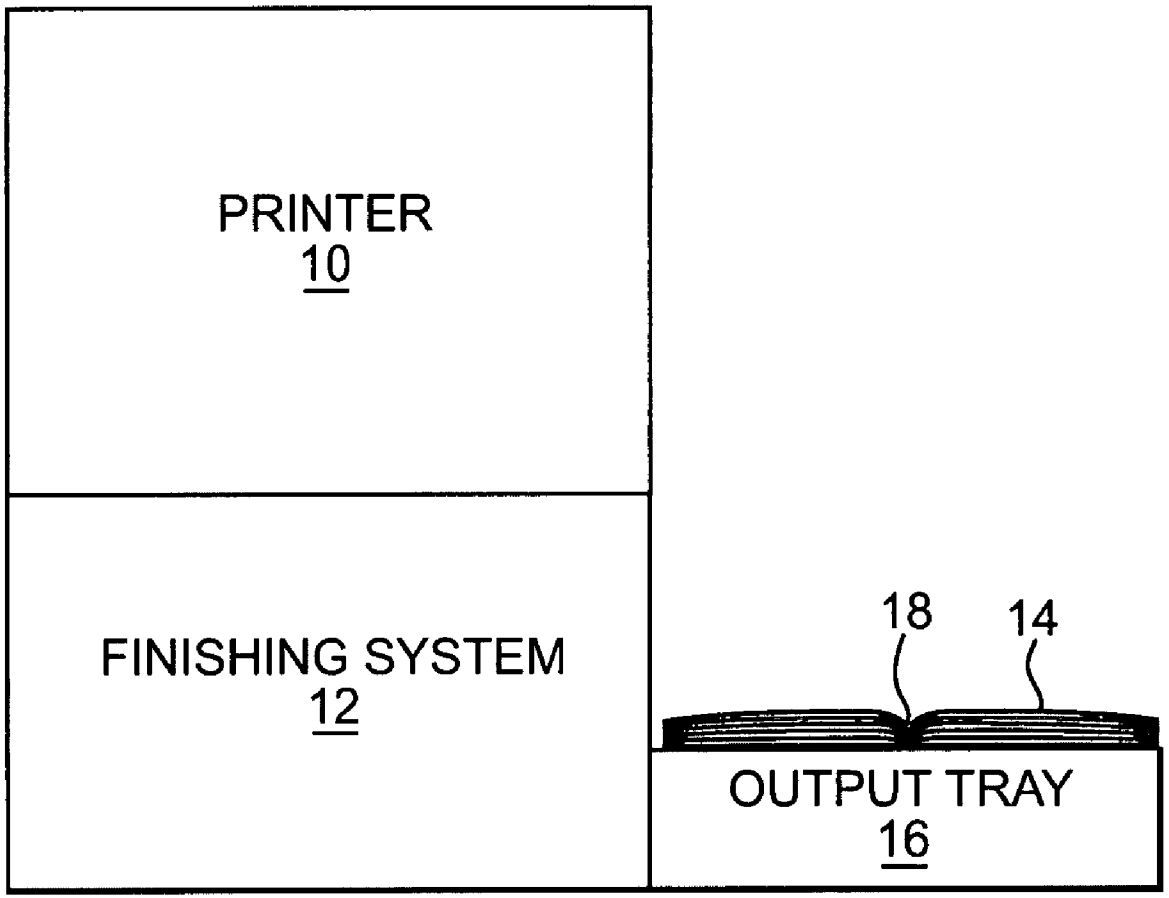
FIG. 1 is block diagram illustrating one embodiment of a printer and a finishing system suitable for use in forming bound documents.

FIG. 1 is a block diagram illustrating one embodiment of a printer 10 and a finishing system 12 suitable for use in forming bound documents or booklets as part of a low-cost system configured to produce finished documents in the electronic publishing environment. In one embodiment, printer 10 prints a plurality of sheets which are fed to finishing system 12 for collating, scoring, binding, and performing other finishing operations, if any. Finishing system 12 outputs the bound document 14 to output tray 16. In one embodiment, finishing system 12 is configured to process and output sheets in an open or unfolded configuration. The output bound document 14 is produced with a score line along its spine 18 to facilitate subsequent folding of bound document 14 manually or with a mechanical folding device. In this manner, since finishing system 12 does not generally produce a folded, bound document 14, motor capacity and finishing forces are decreased providing a printer 10 and finishing system 12 having attributes more conducive for use in an office or desktop environment.

Figure 2:
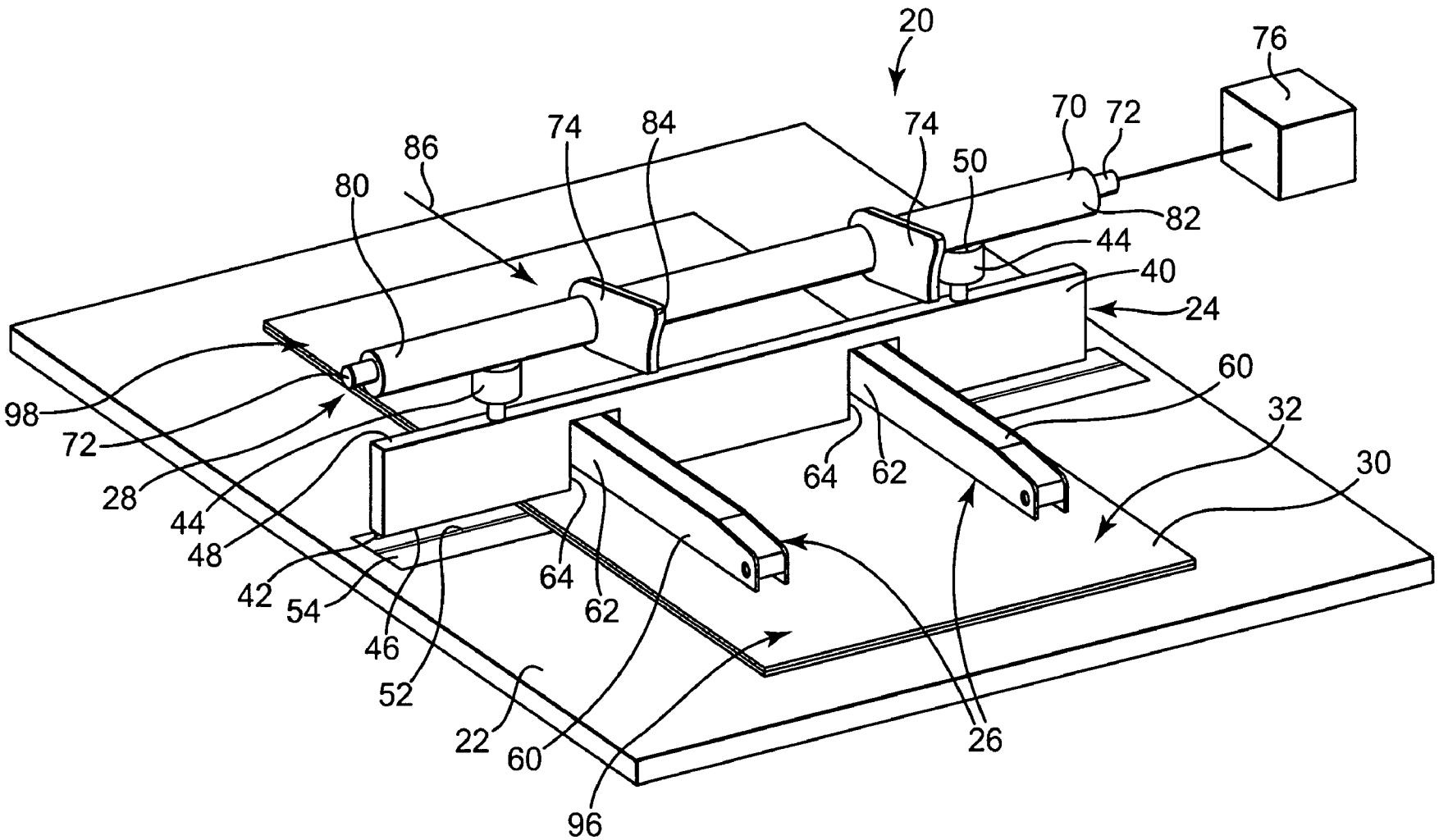
FIG. 2 is a perspective view illustrating one embodiment of a finishing apparatus configured for scoring and binding a plurality of sheets.

FIG. 2 illustrates a finishing apparatus or station 20 included within finishing system 12 of FIG. 1. In one embodiment, finishing apparatus 20 includes a support surface 22, a scoring mechanism 24, a binding mechanism 26, and an actuation mechanism 28. Support surface 22 is substantially planar and is configured to support movement of sheets, generally illustrated by the plurality of sheets 30, received from printer 10 and accumulated into a sheet stack 32. Scoring mechanism 24 and binding mechanism 26 are each configured to interact with sheets 30 supported by support surface 22, and actuation mechanism is configured to activate and/or drive each mechanism 24 and 26.

More particularly, scoring mechanism 24 is configured to score sheet stack 32 to facilitate subsequent folding of sheet stack 32. Binding mechanism 26 is configured to bind sheet stack 32 to form bound document 14 (illustrated in FIG. 1). In one embodiment, scoring mechanism 24 and binding mechanism 26 are each configured to act upon sheet stack 32 while sheet stack 32 is maintained in a single position on support surface 22. In one example, actuation mechanism 28 is configured to induce scoring and binding of sheet stack 32 by the respective scoring mechanism 24 and binding mechanism 26.

In one embodiment, scoring mechanism 24 includes a score bar 40, a score blade 42, and contact pads 44. Score bar 40 is an elongated bar or plate that extends over at least a portion of a width of support surface 22, and is spring-loaded or otherwise biased to be spaced from support surface 22. Score bar 40 defines a lower edge 46 spaced from and extending parallel to a width of support surface 22. Lower edge 46 of score bar 40 is positioned relatively near to support surface 22 as compared to the other edges of score bar 40. In one embodiment, score blade 42 linearly extends along a substantial entirety of lower edge 46 of score bar 40. Score blade 42 is any suitable blade configured to impart a score line along at least one sheet 30 as will be further described below. In one embodiment, score blade 42 extends from score bar 40 with one of a rounded profile, a rectangular profile, and a triangular pointed profile.

Contact pads 44 extend from an upper edge 48 opposite lower edge 46 of score bar 40 and are configured to interact with actuation mechanism 28. In one embodiment, score bar 40 is configured to interact directly with actuation mechanism 28 and no intervening contact pads 44 are included.

Scoring mechanism 24 is generally configured to move or be moved toward support surface 22. In one embodiment, support surface 22 includes a groove 52 configured to longitudinally align with score bar 40, or more particularly, score blade 42. As such, score bar 40 is configured to move toward and/or fit at least partially within groove 52. In one example, groove 52 is formed as part of a contact plate 54 configured to withstand the forces of score blade 42 as it is moved toward support surface 22. Contact plate 54 may be coupled with and/or embedded at least partially below support surface 22. In one alternate embodiment, score bar 40 defines a groove, and contact plate 54 defines a score blade configured to at least partially fit within the groove and having one of a rounded profile, a rectangular profile, and a triangular profile.

Binding mechanism 26 is any binding mechanism configured to bind sheet stack 32. In one example, binding mechanism 26 includes one or more staplers 60. Staplers 60 are supported by a frame (not illustrated) of finishing apparatus to extend over support surface 22. More specifically, in one example, two staplers 60 are included and are laterally spaced from each other along a width of support surface 22. Each stapler 60 is biased to be spaced from support surface and is configured to staple when depressed to contact sheet stack 32. Staplers 60 may be electrically or mechanically activated staplers or any other suitable staplers 60 or other binding mechanisms.

In one embodiment, stapler heads 62 of staplers 60 are positioned in line with score bar 40, more particularly, score blade 42. In one embodiment, score bar 40 and score blade 42 each extends substantially continuously over a width of support surface 22 except for breaks in continuity, which defines gaps 64 that are each configured to receive one stapler head 62. In one embodiment, staplers 60 are partially or fully supported by score bar 40 and are independently movable toward support surface 22 as compared to score bar 40. In one embodiment, staplers 60 are supported over support surface 22 by any other suitable support mechanism.

For example, as illustrated with reference to FIG. 3A, each stapler 60 is supported over support surface 22 by a support mechanism 64 (not illustrated in FIG. 2 for clarity). In one embodiment, support mechanism 64 is substantially L-shaped and defines a first portion 65 and a second portion 66. First portion 65 is secured to the frame (not illustrated) of finishing apparatus 20 and extends substantially parallel to support surface 22. Second portion 66 extends from first portion 65 towards support surface 22. An end of stapler 60 opposite stapler head 62 is rotatably secured to second portion 66 of support mechanism 64 opposite first portion 65. In one embodiment, a spring 68 or other biasing mechanism extends from first portion 64 and is secured to stapler 60. Spring 68 biases stapler head 62 to be spaced from support surface 22.

In one embodiment, a single support mechanism 64 extends across support surface 22 and supports both staplers 60. In one embodiment, a separate support mechanism 64 is provided to support each stapler 60. Use of other support mechanisms configured to support staplers 60 are also contemplated. Use of other binding mechanisms is also contemplated. For example, in one embodiment, a binding mechanism is included that utilizes adhesive instead of staples to bind sheets 30 into bound document 14 (illustrated in FIG. 1)

Actuation mechanism 28 is utilized to activate each of scoring mechanism 24 and binding mechanism 26. In particular, in one embodiment, actuation mechanism 28 includes an elongated rod 70, first and second frame interconnects 72, one or more cam levers 74, and an actuator 76. Elongated rod 70 is positioned to laterally extend over and to longitudinally align with score bar 40. Accordingly, in one example, elongated rod 70 extends substantially parallel to score bar 40. In one embodiment, elongated rod 70 is substantially cylindrical and positioned to extend directly over or to interact with contact pads 44 of scoring mechanism 24. Elongated rod 70 defines a first end 80 and a second end 82. Frame interconnects 72 extend from opposite ends 80 and 82 of elongated rod 70 and are each configured to rotatably connect with or to facilitate connection with a frame (not illustrated for clarity) of finishing apparatus 20. With this in mind, frame interconnects 72 are secured to the frame in a generally stationery position while still being rotatable about their connection to the frame. As such, elongated rod 70 and frame interconnects 72 collectively rotate about a rotational axis generally indicated at 83.

In one embodiment, each frame interconnect 72 is more particularly a relatively short cylinder that is offset or non-concentrically placed with respect to each corresponding end 80 and 82 of elongated rod 70. The non-concentric placement of each frame interconnect 72 relative to elongated rod 70 allows rod 70 to function as a cam for actuating scoring mechanism 24, as will further be described below.

A cam lever 74 extends from an interior position (i.e., a position between ends 80 and 82) of elongated rod 70. More specifically, each cam lever 74 extends from an interior position along elongated rod 70 to laterally align with one of staplers 60. In one embodiment, an individual cam lever 74 is provided to interact with each stapler 60 of binding mechanism 26. In one example, each cam lever 74 includes a bar or plate and defines a contact surface 84 configured to selectively interact with a corresponding stapler 60. In one example, contact surface 84 is a substantially angled and/or curved surface configured to provide additional mechanical advantage to activate staplers 60.

In one embodiment, actuator 76 is coupled with and is configured to drive rotation of elongated rod 70 and frame interconnects 72 within a finishing apparatus frame (not illustrated) of finishing apparatus 20, which supports elongated rod 70 and frame interconnects 72 above support surface 22. In one embodiment, actuator 76 is any manually, mechanically, or electrically based drive configured to activate one or both of scoring mechanism 24 and/or binding mechanism 26. In one example, actuator 76 is configured to provide a mechanical advantage to actuation mechanism 28 via, for example, an arrangement of gears or levers.

Figure 3A:
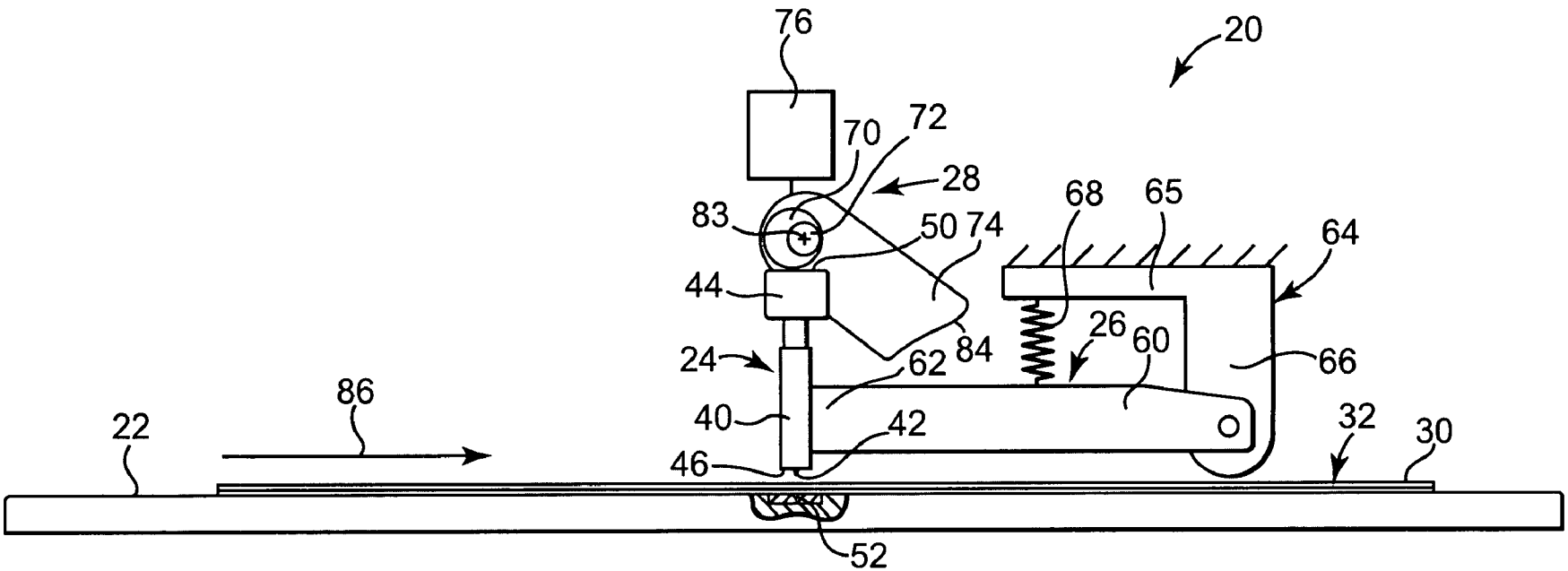
FIG. 3A is a side view illustrating the finishing apparatus of FIG. 2 in a neutral position.

In FIG. 3A, finishing apparatus 20 is illustrated in a neutral or biased position. In particular, while in the neutral position, rotational axis 83 is positioned downstream based on sheet path 86 and relative to a majority of elongated rod 70. In this position, score bar 40 is biased to be spaced from support surface 22. While in the neutral position, elongated rod 70 is also positioned such that each cam lever 74 is generally not in contact with or is at least not generally providing any substantial force to each corresponding stapler 60. In one example, cam levers 74 are spaced from staplers 60 in the neutral position.

Figure 3B:
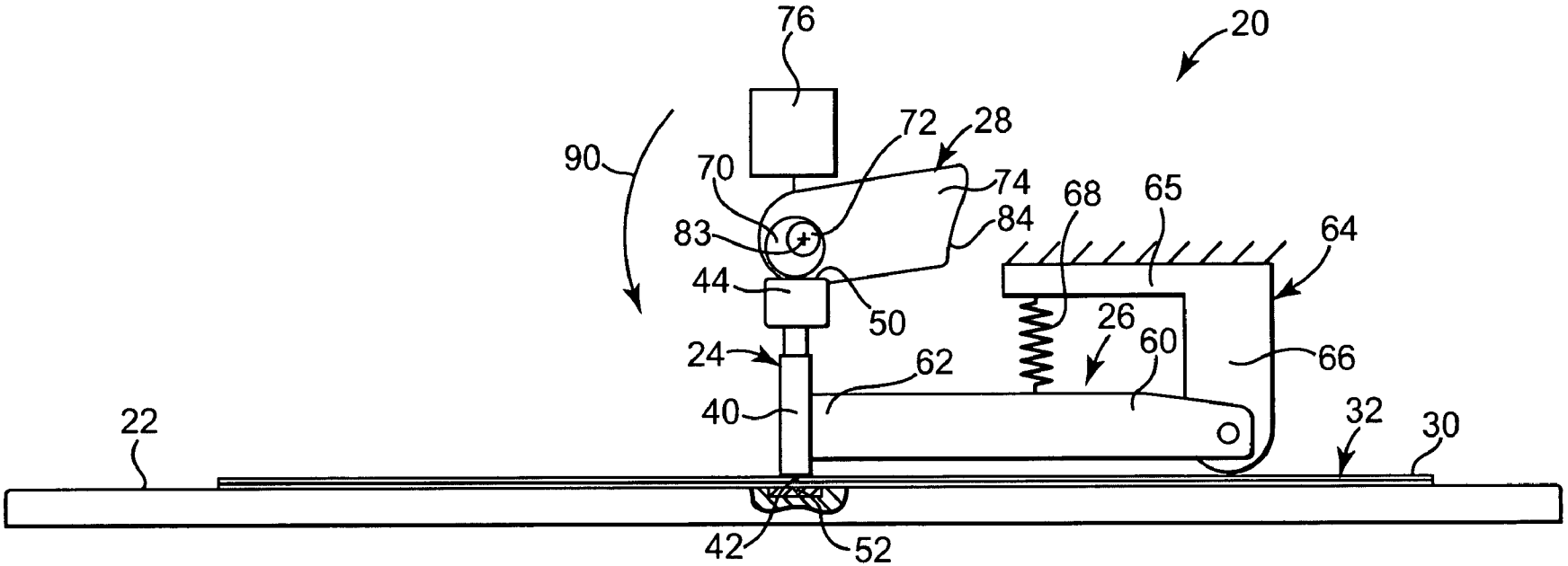
FIG. 3B is side view illustrating the finishing apparatus of FIG. 2 in a scoring position.

In FIG. 3B, actuator 76 rotates elongated rod 70 in a first direction, generally indicated by arrow 90, from the neutral position to a scoring position. In transition from the neutral position to the scoring position, elongated rod 70 and frame interconnects 72 are rotated about rotational axis 83 such that elongated rod 70 extends a further distance from rotational axis 83 toward support surface 22 than elongated rod 70 extended from rotational axis 83 toward support surface 22 while in the neutral position of FIG. 3A. As such, elongated rod 70 applies a force to score bar 40, more particularly, to contact pads 44 of scoring mechanism 24 and presses score bar 40 toward support surface 22. In particular, score bar 40 is forced toward support surface 22 such that score blade 42 is positioned within or at least moved toward groove 52. As such, any sheets 30 positioned between score blade 42 and support surface 22 are scored along the width of sheets 30 being impacted by score blade 42.

Following scoring of the respective sheet 30 or sheet stack 32, actuator 76 rotates elongated rod 70 in a second direction, generally indicated by arrow 92, which is opposite the first direction 90, back to the neutral position illustrated in FIG. 3A. In one embodiment, elongated rod 70 is rotated in the second direction 92 beyond the neutral position and into a binding position illustrated in FIG. 3C. When rotated from the neutral position to the binding position, elongated rod 70 extends from rotational axis 83 toward support surface 22 a smaller distance than when in the neutral position of FIG. 3A. As such, the forces previously applied to score bar 40 via contact pads 44 in the scoring position are removed and score bar 40 is biased to be spaced from support surface 22.

Rotation of elongated rod 70 between the neutral position and the binding position also rotates cam levers 74, which are securely attached to elongated rod 70. In particular, each cam lever 74 rotates toward and eventually contacts a corresponding stapler 60. As cam levers 74 contact staplers 60, the corresponding stapler heads 62 are depressed to cause stapling of any sheet 30 or sheet stack 32 positioned between support surface 22 and staples 60. More particularly, in one embodiment, each cam lever 74 applies a force to the corresponding stapler 60 that overcomes the bias of spring 68 and rotates the corresponding stapler 60 about its connection with support mechanism 64. Rotation of each stapler 60 depresses the corresponding stapler head 62 to contact and staple sheet stack 32.

Figure 3C:
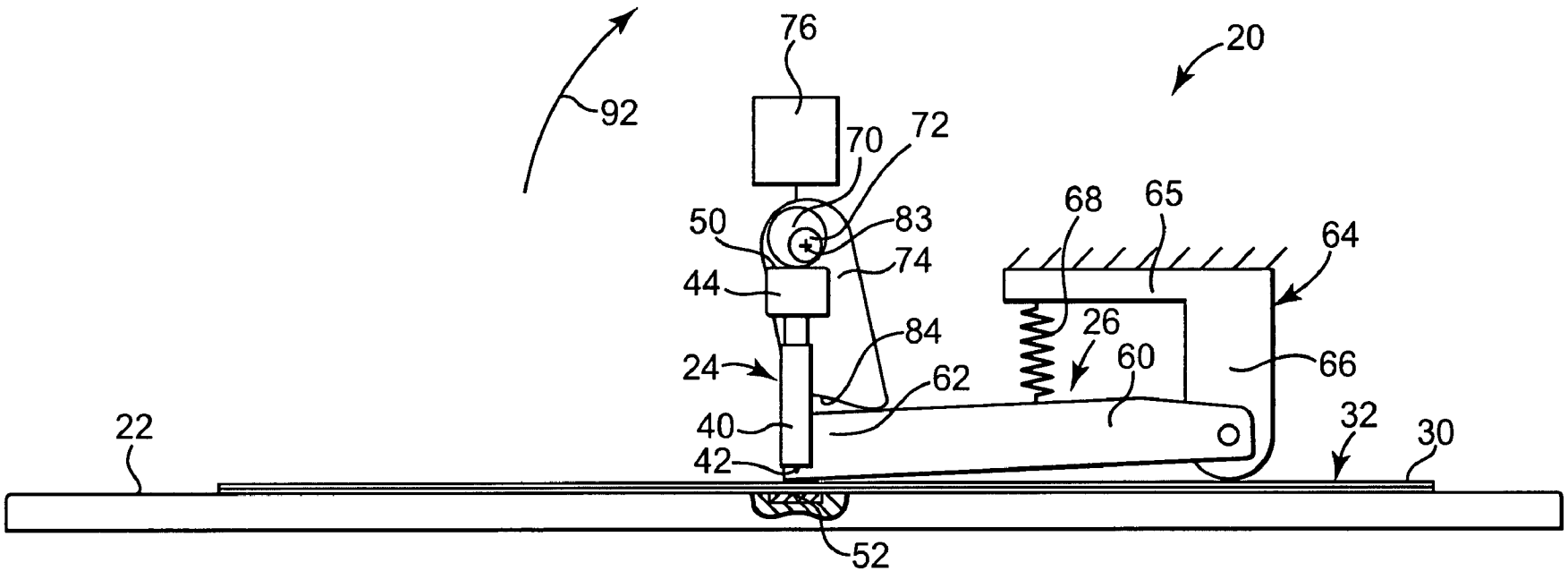
FIG. 3C is a side view illustrating the finishing apparatus of FIG. 2 in a binding position.

In one embodiment where each cam lever 74 includes a generally angled and/or curved stapler contact surface 84, the angular shape of stapler contact surface 84 is configured to more evenly apply pressure to stapler 60 as elongated rod 70 is fully rotated to the binding position illustrated in FIG. 3C. Once staples are inserted into sheet stack 32, actuator 76 rotates elongated rod 70 from the binding position back toward the neutral position illustrated in FIG. 3A to release stapler heads 62 from interacting with sheet stack 32.

Once rotated back to the neutral position illustrated in FIG. 3A, a scored and bound document comprising the plurality of sheets 30 is provided. As such, additionally referring to FIGS. 1 and 2, the now bound sheet stack 32 continues along sheet path 86 to be output from finishing apparatus 20 to output tray 16 or another finishing station, such as a trimming station, hole-punching station, folding station, etc., within finishing system 12.

Figure 4:
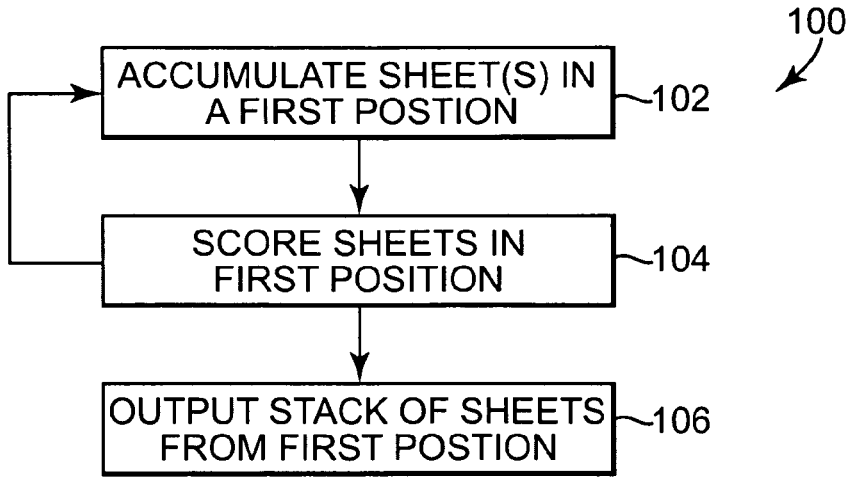
FIG. 4 is a flow chart generally illustrating one embodiment of a method of finishing a document.

FIG. 4 generally illustrates a method of finishing a document at 100. At block 102, sheets are received from a printer and are accumulated into a stack of sheets in a first position between the support surface and a score bar. At block 104, the sheets accumulated in the first position are scored. At block 106, the scored sheet stack is output from the first position. In one embodiment, sheet stack 32 is output from the first position to another position or to another finishing station, such as a trimming station, hole-punching station, folding station, etc. or is output directly to output tray 16 (illustrated in FIG. 1). In one example, the sheet stack is output from the first position in a flat or open configuration.

Figure 5:
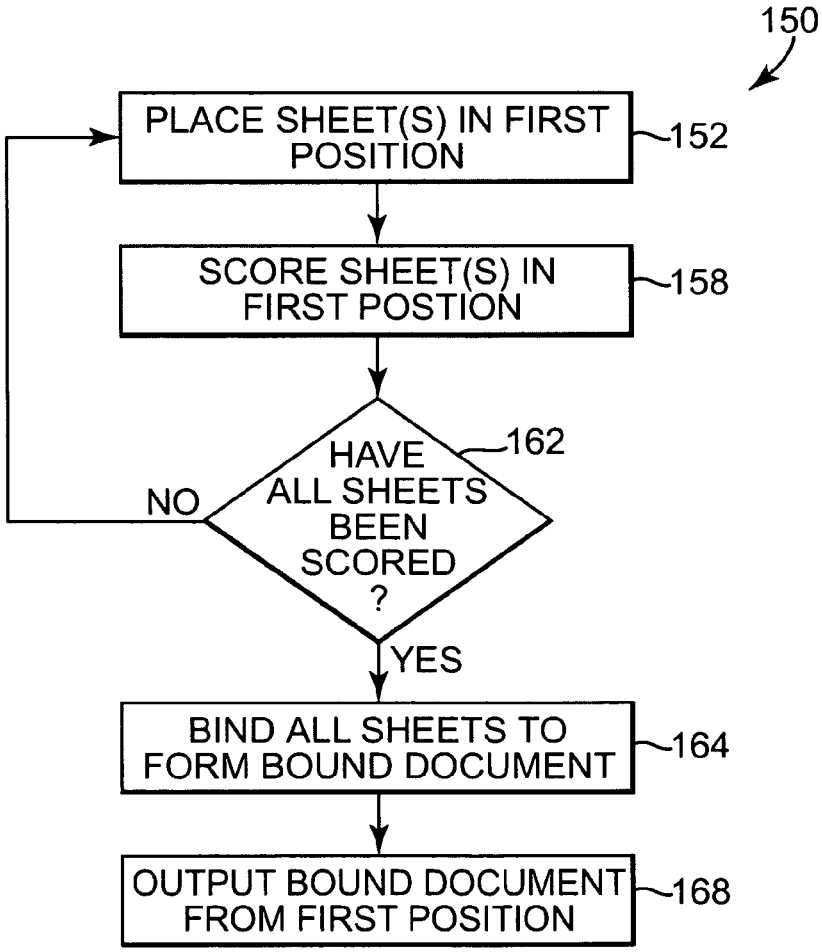
FIG. 5 is a flow chart generally illustrating one embodiment of a method of finishing a document.

FIG. 5, in view of FIGS. 2-3C, generally illustrates a more particular embodiment of a method of finishing a document at 150 utilizing finishing apparatus 20. At block 152, one or more sheets 30 are positioned or accumulated between support surface 22 and score bar 40 using any suitable alignment and/or jogging device or method. More specifically, as illustrated with reference to FIG. 2 and FIG. 6, each sheet 30 is positioned upon support surface 22 such that score bar 40 aligns with a binding edge or spine 18 of bound document 14. In one embodiment, each sheet 30 is individually aligned or jogged with the other sheets 30 as each sheet 30 is added to sheet stack 32 for scoring. As such, when positioned for scoring, the portion of each sheet 30 extending upstream from score bar 40 will be included in a first side 154 of bound document 14, and the portion of sheet 30 extending downstream from score bar 40 will be included in a second side 156 of bound document 14. Sheets 30 are positioned for finishing using any suitable jogging and/or alignment device or method.

Referring once again to FIG. 5, once one or more sheets 30 are positioned for scoring, sheet(s) 30 are scored at block 158. More particularly, actuator 76 rotates elongated rod 70 from the neutral position to the score position, such as that score bar 40 is moved toward support surface 22, thereby, depressing and applying pressure to the one or more sheets 30 positioned between score bar 40 and support surface 22. In one embodiment, during scoring, sheet 30 is clamped or compressed between score blade 42 of score bar 40 and groove 52 formed in support surface 22. Scoring results in a generally flat or open bound document 14 having a depressed or slightly cut score line 160 along a spine 18 as illustrated with respect to the scored sheet stack 32 illustrated in FIG. 6. In one embodiment, each sheet 30 is positioned and scored, while in other embodiments, more than one and up to all of the sheets 30 of bound document 14 are accumulated in a sheet stack 32 and scored in a single scoring operation. In one example, the size of sheet stack 32 is limited by the spacing between support surface 22 and score blade 42 while in the neutral position.

After scoring, actuator 76 rotates elongated rod 70 in second direction 92 back to the neutral position. Referring to FIG. 5, at block 162, it is determined whether all sheets 30 that will be included bound document 14 have been scored as desired by a user. If it is determined at block 162 that a user desires additional sheets 30 to be included in bound document 14 to be scored, one or more of the remaining sheets 30 is fed into finishing apparatus 20 and added to the top of the already scored sheet stack 32. Sheet stack 32 with the newly accumulated sheets 30 is scored, etc. by repeating blocks 152, 158, and 162 as necessary. If at block 162 it is determined that all sheets 30 in bound document 14 have been scored as desired by the user, then at block 164, the plurality of sheets 30 are bound together to form bound document 14.

Figure 6:
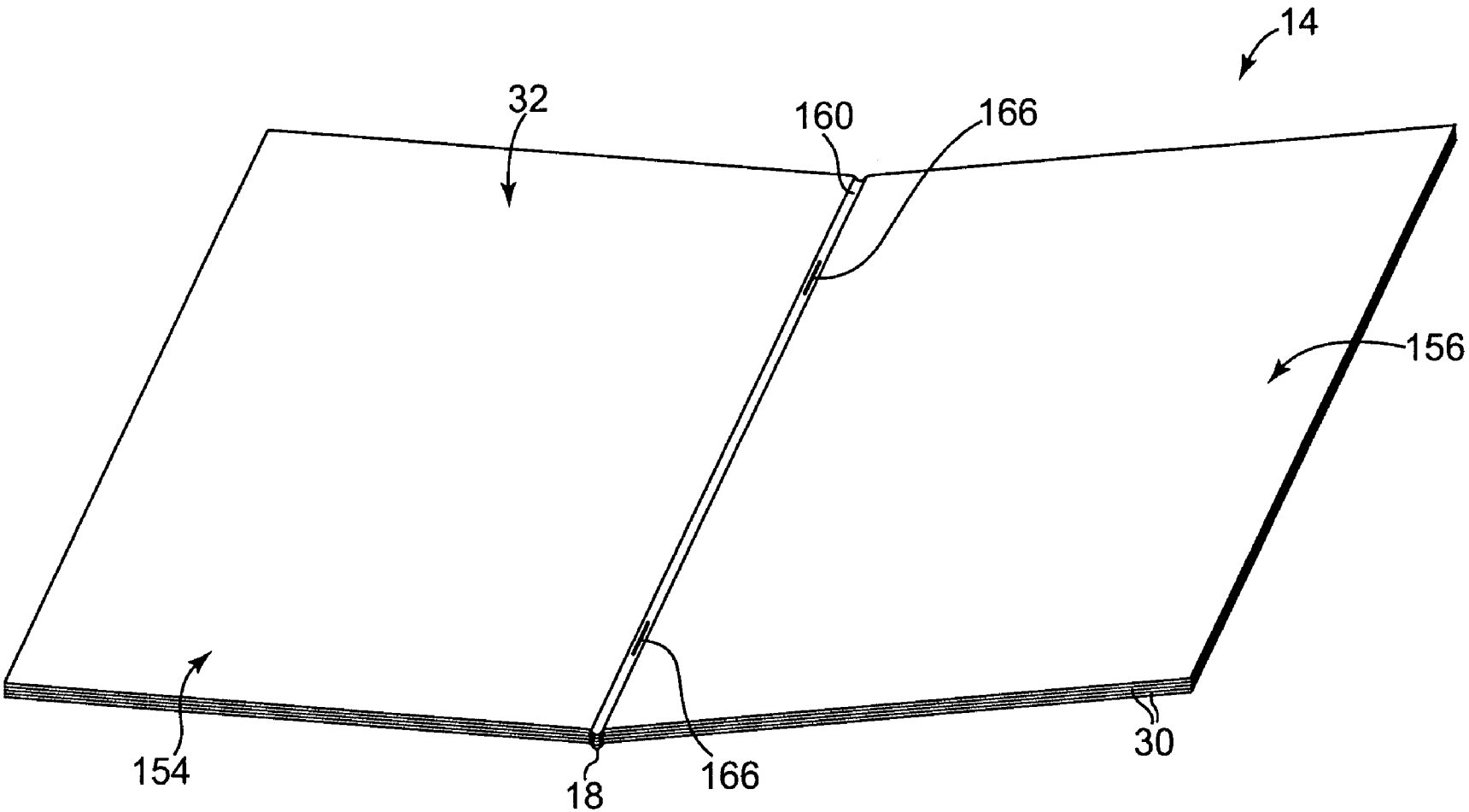
FIG. 6 is a perspective view illustrating one embodiment of a scored and bound stack of sheets.

For example, referring to FIGS. 2-3C, in one embodiment, actuator 76 rotates elongated rod 70 from the neutral position or directly from the scoring position toward and into the binding position. Rotation of elongated rod 70 into the binding position rotates cam levers 74 toward each corresponding stapler 60. Upon rotation of elongated rod 70 to the binding position, each cam lever 74 impacts and depresses stapler 60, more particularly, stapler head 62, toward sheet stack 32 on support surface 22. The depression of stapler head 62 causes a staple to be released and deployed into sheet stack 32 to bind sheet stack 32 into bound document 14. For example, bound document 14 of FIG. 6 illustrates sheets 30 bound by staples 166. In other embodiments, separate actuating mechanisms may be used to activate scoring of sheets 30 and to activate stapling or other binding of bound document 14. In one embodiment, staplers 60 are actuated with an electrical, mechanical or other suitable automatic stapler mechanism.

At block 168, illustrated in FIG. 5, the now bound document 14 continues along longitudinal sheet path 86 out of finishing apparatus 20 and is dispensed to output tray 16 (illustrated in FIG. 1) or to another finishing apparatus or position within finishing system 12 (illustrated in FIG. 1), such as a trimming apparatus, a hole-punching apparatus, a folding apparatus, etc. In one embodiment, bound document 14 is output into output tray 16 in a flat or open configuration. However, due to the scoring of bound document 14, an end user can easily manually or otherwise fold bound document 14 into a closed, bound document. In this manner, the forces required to fold the document and the space utilized to manipulate the document for folding are greatly reduced if not eliminated, which in turn greatly reduces the overall forces within and space occupied by finishing apparatus 20.

Figure 7A:
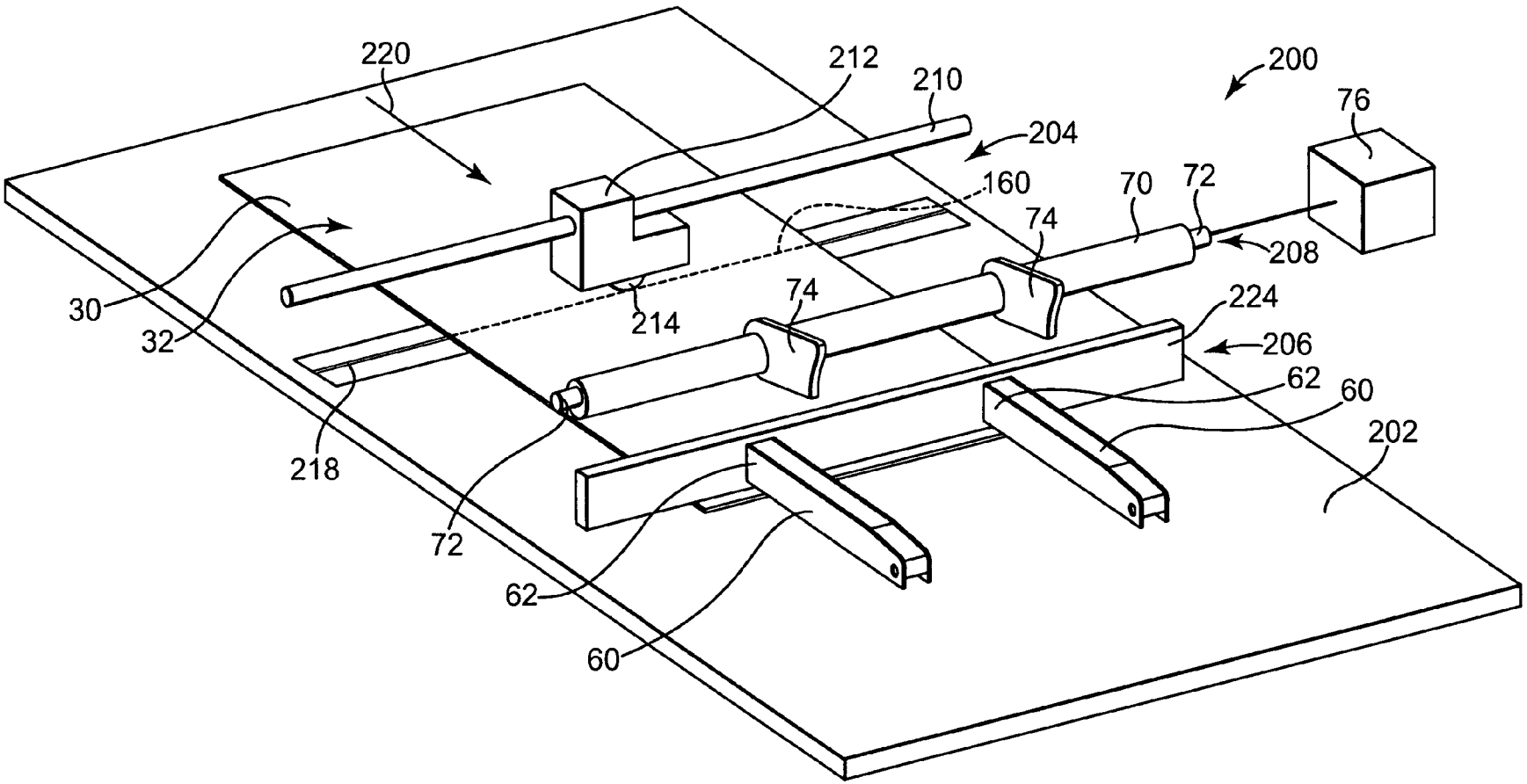
FIG. 7A is a perspective view illustrating one embodiment of a finishing apparatus during a scoring operation.
Figure 7B:
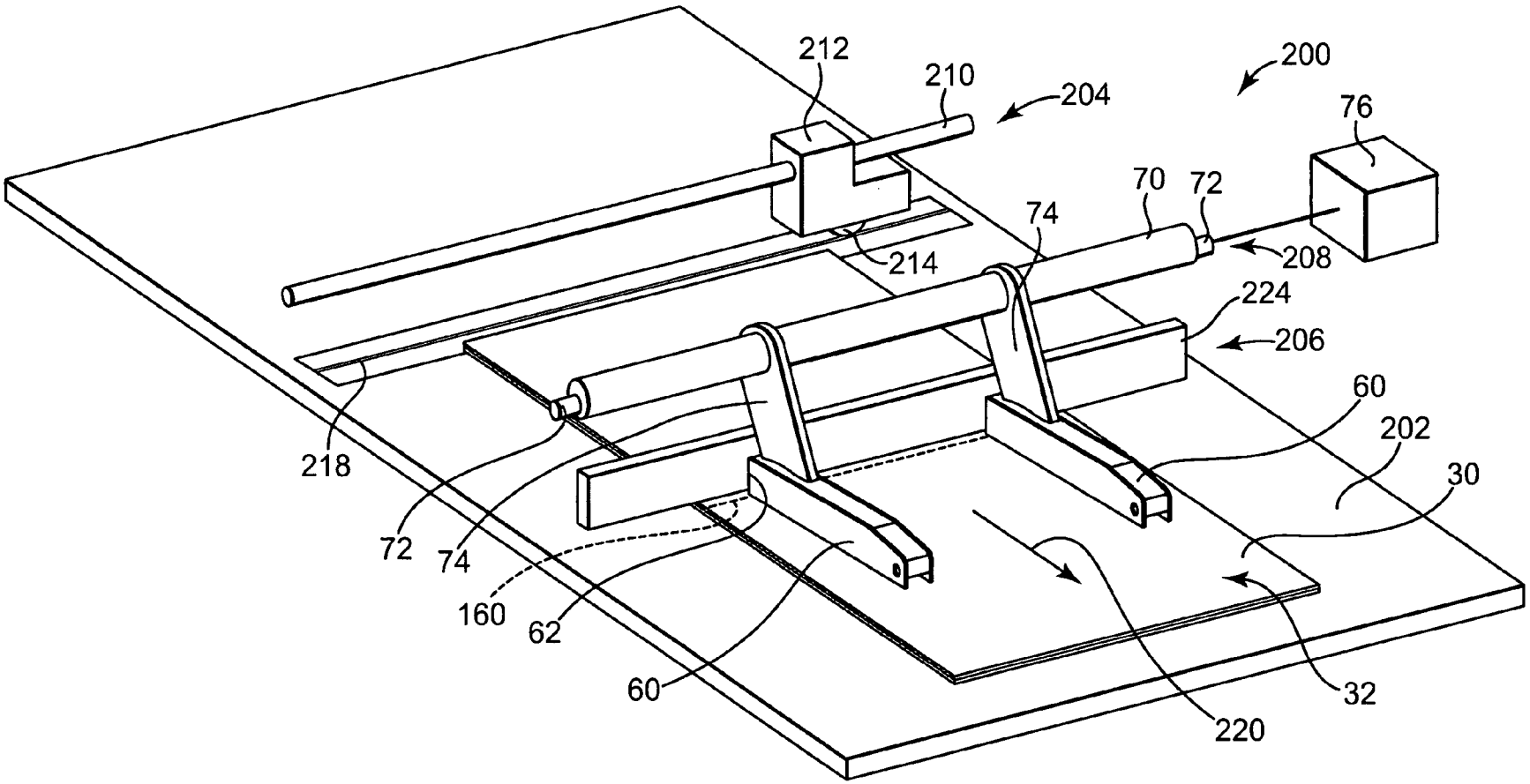
FIG. 7B is a perspective view illustrating one embodiment of the finishing apparatus of FIG. 7A in a binding operation.

FIGS. 7A and 7B illustrate another embodiment of a finishing apparatus generally at 200. Finishing apparatus 200 includes a support surface 202, a scoring mechanism 204, a binding mechanism 206, and at least one actuation mechanism 208. Support surface 202 is similar to support surface 22. Scoring mechanism 204 and binding mechanism 206 are each configured to interact with sheets 30 supported by support surface 202, and actuation mechanism 208 is configured to actuate one or both of scoring mechanism 204 and binding mechanism 206.

Figure 8:
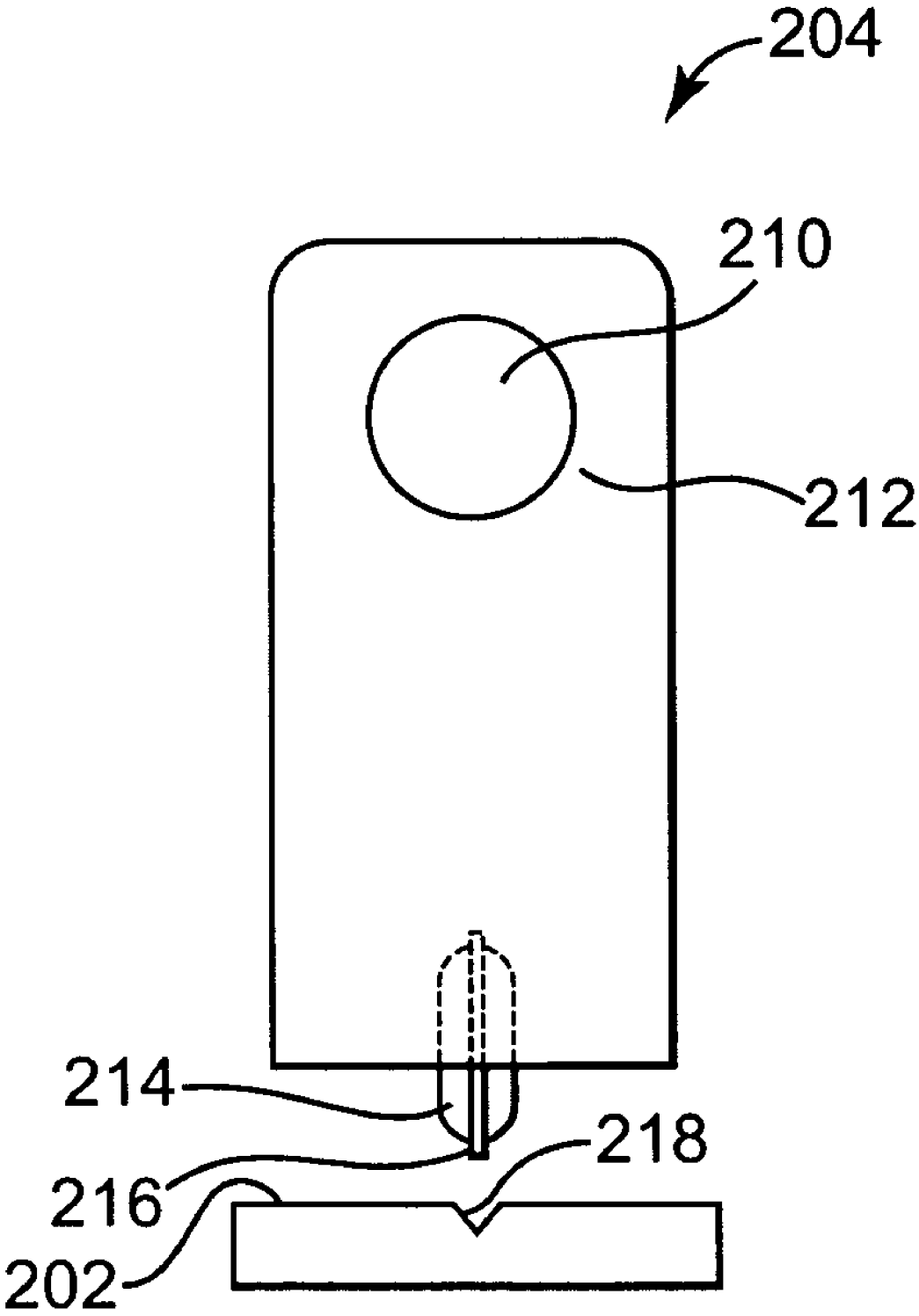
FIG. 8 is a side view illustrating one embodiment of a scoring mechanism included in the finishing apparatus of FIGS. 7A and 7B.

Like scoring mechanism 24, scoring mechanism 204 is configured to score sheet stack 32. With additional reference to the side view of FIG. 8, in one embodiment, scoring mechanism 204 includes a support rod 210, a translating member 212, and a score wheel 214. Support rod 210 is spaced from and extends over and across at least a portion of a width of support surface 202. Translating member 212 is supported by and configured to translate along support rod 210. In one embodiment, score wheel 214 is rotatably support by translating member 212 such that at least a portion of score wheel 214 extends outside of translating member 212 substantially opposite support rod 210. In one example, score wheel 214 includes a score blade 216 extending about the circumference of score wheel 214. In one example, score blade 216 extends about the circumference of score wheel 214 with one of a rounded profile, a rectangular profile, and a triangular pointed profile.

Score wheel 214 is generally configured to contact support surface 202 or a sheet(s) 30 disposed thereon and to roll across the respective support surface 202 or sheet(s) 30 as translating member 212 moves across support rod 210. In one embodiment, support surface 202 includes a wheel track or groove 218 linearly extending across at least a portion of a width of support surface 202 and configured to receive and/or guide the linear travel of wheel 214 and blade 216 across support surface 202. In one embodiment, score wheel 214 alternately defines a groove, and support surface 202 alternately defines a score blade configured to be received by the score wheel groove and having one of a rounded profile, a rectangular profile, or a triangular pointed profile.

Binding mechanism 206 extends across a second width of support surface 202 positioned downstream from scoring mechanism 204 along a sheet path generally indicated by arrow 220. In one embodiment, binding mechanism 206 includes one or more staplers 60 and a support bar 224 or other suitable support mechanism for maintaining staplers 60 generally spaced from support surface 202. In one embodiment, staplers 60 are each supported by a support mechanism similar to support mechanism 64 illustrated in FIG. 3A and described above with respect to binding mechanism 26. In one embodiment, binding mechanism 206 is configured to bind sheet stack 32 with adhesive rather than staples.

In one embodiment, actuation mechanism 208 is similar to actuation mechanism 28 described above. As such, actuation mechanism 208 includes an elongated rod 70, frame interconnects 72, cam levers 74, and actuator 76. Actuation lever is configured to be rotated to induce rotation of elongated rod 70. Referring to FIG. 7B, rotation of elongated rod 70 rotates cam levers 74, which in turn impact and cause depression of staplers 60, more particularly, of each stapler head 62 of each stapler 60, toward support surface 202 and, thereby, towards a sheet 30 or sheet stack 32, if any, positioned between support surface 202 and binding mechanism 206. Finishing apparatus 200 functions in a similar manner as finishing apparatus 20, however, sheets 30 are translated between scoring and binding operations.

Figure 9:
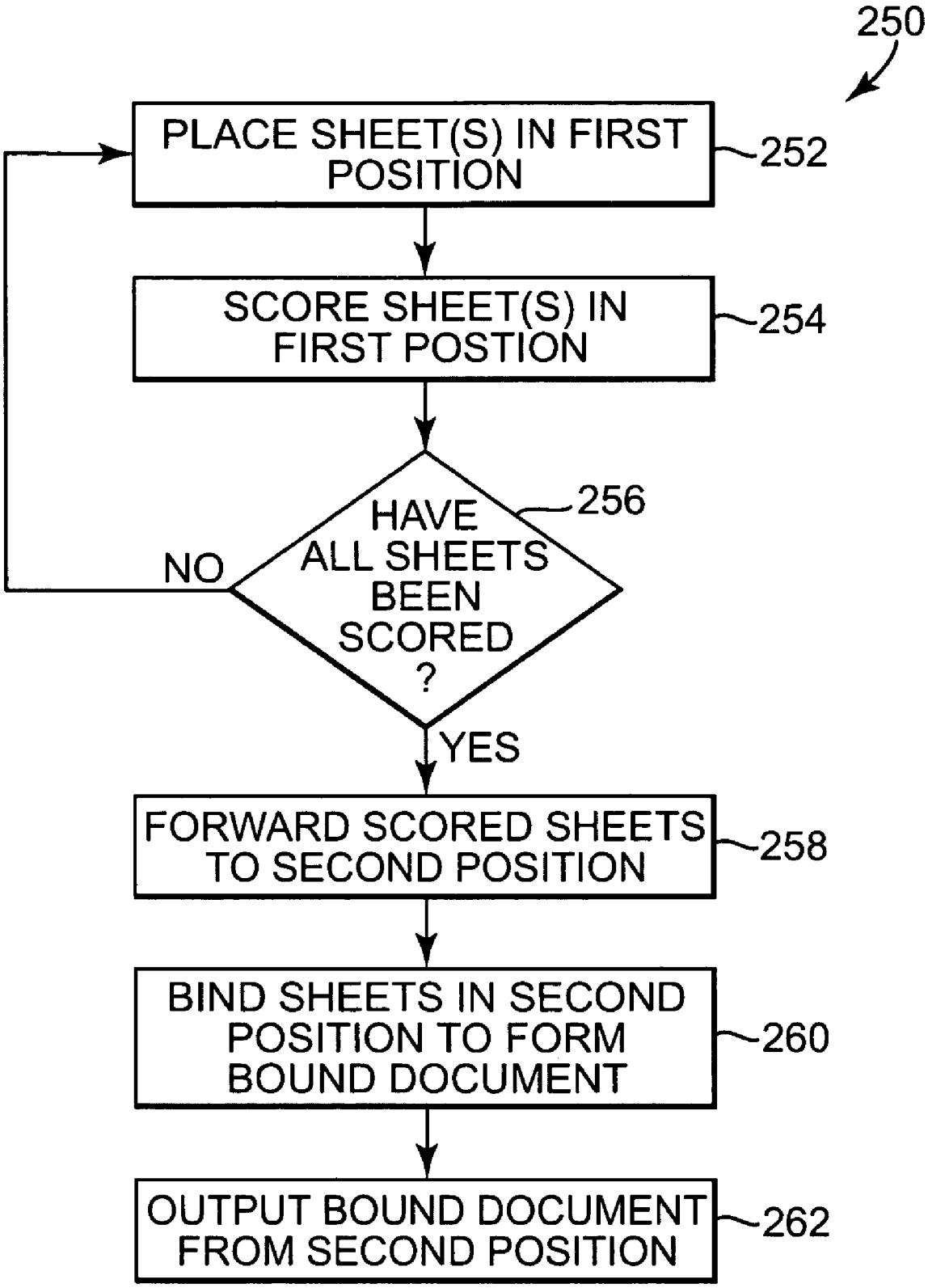
FIG. 9 is a flow chart generally illustrating one embodiment of a method of finishing a document.

More specifically, FIG. 9 in view of FIGS. 7A and 7B generally illustrates one embodiment of finishing sheets for a bound document at 250 utilizing finishing apparatus 200. At 252, sheets 30 are placed or accumulated in a first position between support surface 202 and scoring mechanism 204. At 254, sheets 30 in first position are scored by moving translating member 212 across rod 210, which causes wheel 214 and score blade 216 to move or roll across sheet stack 32, thereby, scoring sheet stack 32 in first position. Any number of sheets 30 may be accumulated in sheet stack 32 at first position prior to scoring. In one embodiment, the number of sheets 30 scored is a predetermined number between one and all sheets 30 to be included in bound document 14.

At 256, it is determined whether all sheets 30 to be include in bound document 14 have been scored as desired by a user. If it is determined at 256 that sheets 30 of bound document 14 still remain to be scored, one or more of the remaining sheets 30 is accumulated on the top of the already scored sheet stack 32 as operation 252 is repeated. Operations 254 and 256 are similarly repeated as necessary.

If at 256 it is determined that all sheets 30 in bound document 14 have been scored as desired, then at 258, the accumulated and scored sheet stack 32 is forwarded from the first position to a second position illustrated in FIG. 7B, which is downstream from the first position with respect to the sheet path 220. In the second position sheet stack 32 is placed between support surface 202 and binding mechanism 206. At 260, sheet stack 32 in second position is bound by binding mechanism 206, more particularly by staplers 60, in a similar manner as described with respect to the method 150 at 164.

At 262, the now bound document 14 is continued along longitudinal sheet path 220 out of finishing apparatus 200 and is dispensed to output tray 16 (illustrated in FIG. 1) or to another finishing apparatus within finishing system 12 (illustrated in FIG. 1), such as a trimming apparatus, hole-punching apparatus, a folding apparatus, etc. As such, in one embodiment, bound document 14 is output into output tray 16 in a flat or open configuration.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A finishing station comprising:

a substantially planar support including a first support surface configured to support a plurality of sheets accumulated into a stack of sheets at a first position of the first support surface;

a scoring apparatus positioned generally opposite the first support surface and opposite to the first position at which the sheets are accumulated, the scoring apparatus remaining generally stationary relative to a width of the first support surface, wherein the scoring apparatus is configured to be vertically movable between a second position spaced apart from the first support surface and a third position in which the scoring apparatus is moved vertically downward toward the first support surface to cause scoring of the respective sheets at the first position of the support surface via the scoring apparatus compressing the sheets between the support surface and the scoring apparatus without the scoring apparatus extending through the support;

a binding mechanism positioned generally opposite to the first support surface and opposite to the first position at which the sheets are scored, the binding mechanism remaining generally stationary relative to the width of the first support surface, wherein the binding mechanism is configured to be vertically movable between a fourth position spaced apart from the first support surface and a fifth position in which the binding mechanism is moved vertically downward toward the first support surface to cause binding of the stack of sheets into a bound document while the stack of scored sheets is in the first position, wherein the scoring apparatus and the binding mechanism both remain positioned above the first surface, and wherein the substantially planar support is sized and shaped to maintain the entire stack of sheets in a substantially flat configuration on the first surface at the first position of the first support surface when the scoring apparatus is in the third position and when binding mechanism is in the fifth position, and an actuating mechanism positioned on a same side of the first support surface as the scoring apparatus and the binding mechanism, wherein the actuating mechanism is located vertically above the scoring apparatus and above the binding mechanism, and the actuating mechanism including a first portion and a second portion while being configured to operate in:

a first mode in which a first portion of the actuating mechanism causes selective movement of the scoring apparatus from the second position to the third position; and a second mode, operating after the first mode, in which a second portion of the actuating mechanism releasably engages the binding mechanism to move the binding mechanism from the fourth position to the fifth position, wherein the second portion of the actuating mechanism extends generally laterally outward from a surface of the first portion of the actuating mechanism, wherein the first portion of the actuating mechanism remains in contact with at least a portion of the scoring apparatus in both the respective first and second modes, and wherein the actuating mechanism, the scoring apparatus, and the binding mechanism remain generally stationary at the first position relative to the width of the first support surface in both the respective first and second modes.

2. The finishing station of claim 1, wherein the scoring apparatus is configured to score the accumulated stack of sheets at the first position in a single scoring operation.

3. The finishing station of claim 1, wherein the scoring apparatus is configured to score individual sheets as each sheet is accumulated at the first position.

4. The finishing station of claim 1, wherein the scoring apparatus is configured to score more than one of the sheets as the sheets are accumulated at the first position.

5. The finishing station of claim 1, wherein the scoring apparatus includes:

a score bar extending across at least a portion of a width of the first surface of the support; and a linear score blade coupled to an edge of the score bar adjacent the first surface, the score blade positioned to score at least one of the sheets at the first position when the scoring apparatus is in the third position.

6. The finishing station of claim 1, wherein the scoring apparatus includes a score blade, and the first surface includes a linear groove configured to receive the score blade.

7. A finishing station comprising:

a substantially planar support including a first surface configured to support a plurality of sheets accumulated into a stack of sheets at a first position;

a scoring apparatus positioned generally opposite the first surface relative to the sheets, wherein the scoring apparatus is movable between a second position spaced apart from the support surface and a third position in which the scoring apparatus causes scoring of the respective sheets at the first position via the scoring apparatus compressing the sheets between the support surface and the scoring apparatus; and a binding mechanism positioned generally opposite the first surface relative to the sheets, wherein the binding mechanism is movable between a fourth position spaced apart from the support surface and a fifth position in which the binding mechanism causes binding of the stack of sheets into a bound document while the stack of scored sheets is in the first position, wherein the binding mechanism comprises at least one stapler configured to bind the stack of sheets with staples linearly aligned with a score line created by the scoring apparatus, wherein the score blade includes at least one gap along a score edge configured to receive at least a portion of the at least one stapler, and wherein the scoring apparatus and the binding mechanism are both positioned above the first surface, and wherein the substantially planar support is sized and shaped to maintain the entire stack of sheets in a substantially flat configuration on the first surface when the scoring apparatus is in the third position and when binding mechanism is in the fifth position.

8. A finishing station comprising:

a substantially planar support including a first surface configured to support a plurality of sheets accumulated into a stack of sheets at a first position;

a scoring apparatus positioned generally opposite the first surface relative to the sheets, wherein the scoring apparatus is movable between a second position spaced apart from the support surface and a third position in which the scoring apparatus causes scoring of the respective sheets at the first position via the scoring apparatus compressing the sheets between the support surface and the scoring apparatus without the scoring apparatus extending through the support, wherein the scoring apparatus includes a score bar; and a binding mechanism positioned generally opposite the first surface relative to the sheets, wherein the binding mechanism is movable between a fourth position spaced apart from the support surface and a fifth position in which the binding mechanism causes binding of the stack of sheets into a bound document while the stack of scored sheets is in the first position, wherein the scoring apparatus and the binding mechanism are both positioned above the first surface, and wherein the substantially planar support is sized and shaped to maintain the entire stack of sheets in a substantially flat configuration on the first surface when the scoring apparatus is in the third position and when binding mechanism is in the fifth position; and an actuating mechanism positioned on a same side of the support as the scoring apparatus and the binding mechanism, the actuating mechanism cooperable with the scoring apparatus to move the scoring apparatus between the second position and the third position, and cooperable with binding mechanism to move the binding mechanism between the fourth position and the fifth position, wherein the actuating mechanism includes:

a rod rotatably mounted in a vertically spaced apart position above the score bar: and a lever mounted on the rod and extending generally perpendicular to the rod, the lever including a first end having a cam portion offset from a rotational axis of the rod and a second end spaced apart from the rod;

wherein upon rotation of the rod in a first rotational direction, the lever rotates to cause the cam portion to pressingly force the score bar, in a generally vertically downward direction, into the second position to score the stack of sheets and upon rotation of the rod in a second rotational direction opposite the first rotational direction, the lever rotates to cause the second end of cam lever to pressingly force the stapler, in the generally vertical downward direction, into the fifth position to cause binding of the stack of sheets.

9. A finishing station comprising:

a substantially planar support including a first surface configured to support a plurality of sheets accumulated into a stack of sheets at a first position;

a scoring apparatus positioned generally opposite the support surface and including a score bar, wherein the scoring apparatus is movable between a second position spaced apart from the support surface and a third position in which the scoring apparatus causes scoring of the respective sheets at the first position via the score bar of the scoring apparatus compressing the sheets between the support surface and the scoring apparatus; and a binding mechanism positioned generally opposite the support surface, wherein the binding mechanism is movable between a fourth position spaced apart from the support surface and a fifth position in which the binding mechanism causes binding of the stack of sheets into a bound document while the stack of scored sheets is in the first position, wherein the scoring apparatus and the binding mechanism both face the first surface; and an actuating mechanism cooperable with the scoring mechanism to move the scoring apparatus between the second position and the third position, and to move the binding mechanism between the fourth position and the fifth position, wherein the actuating mechanism includes:

a rod rotatably mounted in a vertically spaced apart position above the score bar;

a lever mounted on the rod and extending generally perpendicular to the rod, the lever including a first end having a cam portion offset from a rotational axis of the rod and a second end spaced apart from the rod, wherein upon rotation of the rod in a first rotational direction, the lever rotates to cause the cam portion to pressingly force the score bar of the scoring apparatus in a generally vertically downward direction, and into the second position, to score the stack of sheets and upon rotation of the rod in a second rotational direction opposite the first rotational direction, the lever rotates to cause the second end of cam lever to pressingly force the stapler in the generally vertical downward direction, and into the fifth position, to cause binding of stack of sheets.

10. A finishing station comprising:

a substantially planar support including a first support surface configured to support, at a first position, a plurality of sheets accumulated into a stack of sheets;

a scoring apparatus positioned generally opposite the first support surface relative to the first position and generally stationary relative to a width of the first support surface, wherein the scoring apparatus is vertically movable between a second position spaced apart from the support surface and a third position in which the scoring apparatus causes scoring of the respective sheets at the first position via the scoring apparatus compressing the sheets between the first support surface and the scoring apparatus, wherein the scoring apparatus includes a score bar extending across at least a portion of a width of the first support surface and a linear score blade coupled to an edge of the score bar adjacent the first support surface, wherein the score blade is positioned to score at least one of the sheets at the first position when the scoring apparatus is in the third position; and a binding mechanism positioned generally opposite the first support surface relative to the first position and generally stationary relative to the width of the first support surface, wherein the binding mechanism is vertically movable between a fourth position spaced apart from the first support surface and a fifth position in which the binding mechanism causes binding of the stack of sheets into a bound document while the stack of scored sheets is in the first position, wherein the scoring apparatus and the binding mechanism are both positioned above the first support surface, and wherein the substantially planar support is sized and shaped to maintain the entire stack of sheets in a substantially flat configuration on the first support surface when the scoring apparatus is in the third position and when binding mechanism is in the fifth position, and wherein the binding mechanism includes a pair of staplers spaced apart from each other along a length of the score bar, and configured to remain generally stationary relative to the width of the first support surface whether the binding mechanism is in the fourth position or the fifth position.

11. A finishing station comprising:

a substantially planar support including a first support surface configured to support, at a first position, a plurality of sheets accumulated into a stack of sheets;

a scoring apparatus positioned generally opposite the first support surface relative to the first position and generally stationary relative to a width of the first support surface, wherein the scoring apparatus is vertically movable between a second position spaced apart from the support surface and a third position in which the scoring apparatus causes scoring of the respective sheets at the first position via the scoring apparatus compressing the sheets between the first support surface and the scoring apparatus, wherein the scoring apparatus includes a score bar extending across at least a portion of a width of the first support surface and a linear score blade coupled to an edge of the score bar adjacent the first support surface, wherein the score blade is positioned to score at least one of the sheets at the first position when the scoring apparatus is in the third position; and a binding mechanism positioned generally opposite the first support surface relative to the first position and generally stationary relative to the width of the first support surface, wherein the binding mechanism is vertically movable between a fourth position spaced apart from the first support surface and a fifth position in which the binding mechanism causes binding of the stack of sheets into a bound document while the stack of scored sheets is in the first position, wherein the scoring apparatus and the binding mechanism are both positioned above the first support surface, and wherein the substantially planar support is sized and shaped to maintain the entire stack of sheets in a substantially flat configuration on the first support surface when the scoring apparatus is in the third position and when binding mechanism is in the fifth position, and wherein the binding mechanism includes at least one stapler having a stapler head and a body, wherein the stapler head is generally in vertical alignment with a portion of the score bar, wherein a longitudinal axis of the body of the at least one stapler extends generally perpendicular to a length of the score bar.

* * * * *

UNITED STATES PATENT AND TRADEMARK OFFICE

CERTIFICATE OF CORRECTION

PATENT NO. : 7,819,615 B2
APPLICATION NO. : 11/294832
DATED : October 26, 2010
INVENTOR(S) : Steven William Trovinger et al.

It is certified that error appears in the above-identified patent and that said Letters Patent is hereby corrected as shown below:

On the title page, item (73), Assignee, in column 1, line 1,
delete "Development," and insert -- Development Company, L.P., --, therefor.

Signed and Sealed this
Twenty-second Day of March, 2011

David J. Kappos

David J. Kappos
*Director of the United States Patent and Trademark Office*